US007024774B2

(12) United States Patent
Novellie et al.

(10) Patent No.: US 7,024,774 B2
(45) Date of Patent: Apr. 11, 2006

(54) NAIL CLIPPERS

(75) Inventors: Michael Paul Novellie, Douglas (GB); Hendrik Schalk Visser, Hermanus (ZA)

(73) Assignee: Boyne Limited Iom, Douglas (GB)

( * ) Notice: Subject to any disclaimer, the term of this patent is extended or adjusted under 35 U.S.C. 154(b) by 101 days.

(21) Appl. No.: 10/469,100

(22) PCT Filed: Feb. 26, 2002

(86) PCT No.: PCT/IB02/00552

§ 371 (c)(1),
(2), (4) Date: Jan. 5, 2004

(87) PCT Pub. No.: WO02/067720

PCT Pub. Date: Sep. 6, 2002

(65) Prior Publication Data

US 2004/0098861 A1 May 27, 2004

(30) Foreign Application Priority Data

Feb. 26, 2001 (GB) ..... 0104742

(51) Int. Cl.
*A45D 29/02* (2006.01)

(52) U.S. Cl. ..... 30/28; 30/287; 30/27; 30/124; D28/60

(58) Field of Classification Search ..... 30/124, 30/26, 27, 28, 286, 287, 179, 253; 132/75.4, 132/75.5; D28/60
See application file for complete search history.

(56) References Cited

U.S. PATENT DOCUMENTS 796,389 A * 8/1905 Wright ..... 132/75.5
D168,029 S * 10/1952 Haliniewski ..... D28/60
3,812,868 A * 5/1974 Keating ..... 132/75.4
4,176,449 A * 12/1979 Lee et al. ..... 30/28
4,860,448 A * 8/1989 Husain ..... 30/28
D344,366 S * 2/1994 Soriano ..... D28/60
D353,687 S * 12/1994 Dacko ..... D28/60
5,423,124 A * 6/1995 Marrocco ..... 30/28
5,791,049 A * 8/1998 Dolev ..... 30/28
D402,410 S * 12/1998 Farrell ..... D28/60
6,088,919 A * 7/2000 Gilman ..... 30/28

FOREIGN PATENT DOCUMENTS

| | | |
|---|---|---|
| DE | 197 51 097 | 5/1998 |
| FR | 2 603 467 | 3/1988 |
| FR | 2 700 251 | 7/1994 |
| GB | 249289 | 3/1926 |
| JP | 03 026205 | 2/1991 |

OTHER PUBLICATIONS

International Search Report from the International Bureau of WIPO in international application PCT/IB02/00552 (mail date Jun. 5, 2002).

* cited by examiner

*Primary Examiner*—Hwei-Siu Payer
(74) *Attorney, Agent, or Firm*—Marshall, Gerstein & Borun LLP

(57) ABSTRACT

The disclosure provides nail clippers having a pair of jaws shaped to provide oppositely disposed arcuate cutting edges and biased to an open position with a shield extending around and projecting forwardly of the corners of the cutting edges. The shield also can extend rearwardly from the cutting edges to form manipulating levers for operating the jaws. These can be aesthetically designed to provide the nail clippers with the appearance of an animate object such as a butterfly, or an inanimate object such as a vehicle.

34 Claims, 2 Drawing Sheets

NAIL CLIPPERS

This is the U.S. national phase of International Application No. PCT/IB02/00552, the entire disclosure of which is incorporated herein by reference.

FIELD OF THE INVENTION

This invention relates to nail clippers and more particularly to clippers used for manicure and pedicure functions.

BACKGROUND TO THE INVENTION

Nail clippers which have a pair of jaws shaped to form sharpened arcuate co-operating cutting edges at one end and connected together at the other with the length of the jaws bent to bias the jaws to an open position have been widely used for many years.

An operating lever is hinged to a pin passing through the jaws adjacent the cutting edges to provide means whereby the jaws can be moved together to provide a clipping action.

The construction is narrow making the clippers liable to twisting during use. This together with the sharp corners at the ends of the cutting edges can lead to cutting of the flesh around a finger- or toenail being clipped. This is particularly problematic with young children and infants as an adult usually attends to cutting their nails and can misalign their fingers and toes especially when they wriggle about or resist. The latter often results from fear of the implement used.

OBJECT OF THE INVENTION

It is the object of the present invention to provide nail clippers which are easy to use and less likely to cause injury when used than those presently available.

SUMMARY OF THE INVENTION

According to this invention there is provided nail clippers comprising a pair of jaws shaped to provide oppositely disposed arcuate cutting edges and joined together remote from the cutting edges, the jaws biased to an open position and movable against the bias to enable a nail located between the cutting edges to be cut, with a shield extending around and projecting forwardly of the corners of the cutting edges.

Further features of this invention provide for forward projection of the shield around the corners to follow an arcuate shape; for the shield to extend rearwardly from the cutting edges to form manipulating levers for operating the jaws and for the jaws to be integrally joined.

The invention also provides for the manipulating levers to the shield to carry protrusions slideably engaging in depressions formed in the jaws, for the shield and manipulating levers to be an integral moulding from resilient plastics materials and for the moulding to be securely retained on the jaws by barbed clips engaged on assembly of the jaws between the extensions.

Preferably the manipulating levers carry protrusions in the form of cams shaped and positioned to direct force in use from the levers against the jaws.

Preferably the extensions will provide wide finger grips and be aesthetically designed. In particular they may take the form of butterfly wings.

Another aspect of this invention provides a pair of jaws with co-operating cutting edges for nail clippers comprising a single strip of material having a cutting edge formed at each end with the strip bent to allow the cutting edges to co-operate and the bend or the material of the strip or both providing a resilient biasing of the jaws to an open position.

Apertures are preferably provided in the strip, and are sized and shaped to achieve a desired level of resilience in biasing the jaws to an open position.

Still further features of the invention provide for a plug to be movably secured at each side of the jaws adjacent the cutting edges to define together with at least one of the jaws and the shield a containing space for material cut by the cutting edges in use; for the plugs to be movable against a bias; for the plugs to be moulded integrally with a flexible body; for the body to be secured between the jaws intermediate and spaced from the cutting edges; for each plug to seat against the shield; and for the plugs to be shaped to respectively resemble the head and body of a butterfly.

The invention extends to a pair of jaws and a shield, separately and apart from each other, each being arranged for use in a novel nail clipper as defined herein.

The invention further includes a nail clipper comprising a pair of jaws shaped to provide oppositely disposed arcuate cutting edges and biased to an open position with moulded plastics finger grips secured on opposite sides of the jaws.

According to one aspect of the invention there is provided for the finger grips to provide the nail clipper with the appearance of an animate object, including an insect, animal and plant; for the finger grips to particularly provide the nail clipper with the appearance of a winged insect, including a butterfly and bee, or with the appearance of a bird.

According to a further aspect of the invention there is provided for the finger grips to provide the nail clipper with the appearance on an inanimate object, including a vehicle.

Further features of this invention provide for the finger grips to be broader than the width of the jaws; for the finger grips to be securely retained on the jaws by barbed clips; and for the finger grips to be moulded as an integral unit.

BRIEF DESCRIPTION OF THE DRAWING

These and other features will become apparent from the following description of an example wherein reference is made to the accompanying drawings in which.

DETAILED DESCRIPTION OF THE DRAWINGS

Figure 1:
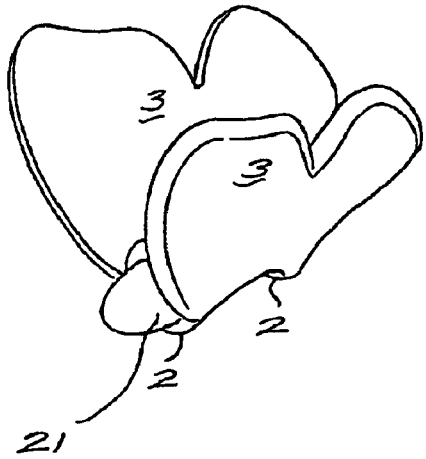
FIG. 1 shows a perspective view of a set of nail clippers.
Figure 2:
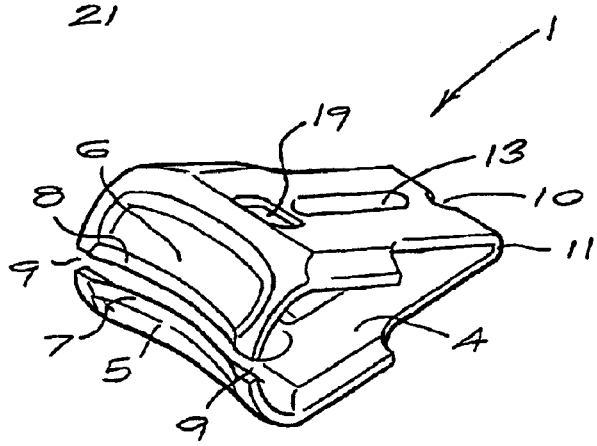
FIG. 2 shows a perspective view of the clipper jaws.
Figure 3:
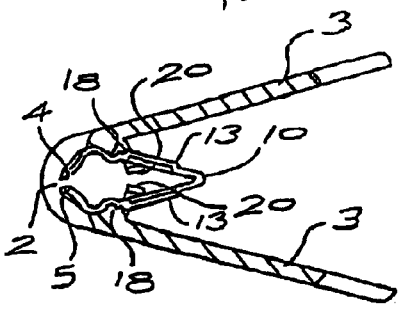
FIG. 3 shows a cross section through the clipper set.

As illustrated a set of nail clippers consists of a pair of jaws (1) and a shield (2) with integral extensions forming manipulating levers (3).

The jaws (1) are shaped from a single strip (4) of suitable steel plate. The strip (4) is wider at each end (5) and (6) which ends are shaped and sharpened to provide the usual form of co-operating arcuate nail cutting edges (7) and (8). These edges have corners (9).

The strip (4) has a central aperture (10) in the narrower section and is bent centrally at (11) so that the cutting edges (7) and (8) are resiliently biased apart but can be dosed together for nail cutting purposes. Stiffening ribs (13) are formed in the strip (4) to provide rigidity between the bend (11) and the wider end sections (5) and (6). The central aperture (10) determines the resilience of the jaws (1) and is designed to provide a dosing pressure for the jaws which is comfortable to exert.

The shield (2) is in the form of a moulding of suitable plastics material and extends around each corner (9) of the jaws (1) while exposing the cutting edges (7) and (8).

The shield (2) forms a hinge between the manipulating levers (3) which project away from the cutting edges and over the jaws (1). Inwardly directed protrusions (18) from the manipulating levers (3) slideably engage in depressions (19) formed in the jaws (1).

The manipulating levers (3) provide finger grips for a user to manipulate the jaws (1).

The shield (2) generally follows the arcuate shape of the cutting edges (7) and (8) but projects forwardly and laterally of these edges.

The manipulating levers (3) are aesthetically shaped so that they resemble the wings of a butterfly and the shield (2) connects the wings in a flared relationship enhancing the resemblance of the assembled nail clippers to a butterfly. The manipulating levers (3) may include reinforcing ribs or other formations to ensure they are sufficiently rigid for use of the clippers.

The plastics mouldings of the shield (2) and manipulating levers (3) is such that the jaws (1) can be forced into position where they are retained by the protrusion (18) engaging in the depression (19). The static condition of the moulding and the bent strip (4) are thus such that the components are securely retained together. Preferably barbed clips indicated generally at (20) are provided on the moulding. These dips (20) will enable the jaws (1) to be inserted within the moulding but be prevented from withdrawal without the exertion of sufficient force to break the clips (20). This ensures that the jaws (1) cannot be unintentionally removed from the protection of the moulding.

A set of arcuate projections (30) further extends inwardly from each the manipulating levers (3) opposite the shield (2) to abut either side of each of the jaws (1). The projections (30) assist in aligning the jaws (1) within the moulding, particularly during operation of the jaws (1) and also define the limit to which the manipulating levers (3) can be moved together.

It will be appreciated that many design considerations well within the knowledge of those skilled in the manufacture of mouldings and steel pressings will be included in the final design. These will enable the complete nail clippers to combine ease of manipulation with adequate opening and closing of the jaws under predetermined pressure.

In use the manipulating levers (3) are held in position with the cutting edges (7) and (8) over a nail to be trimmed. The shield (2) limits the depth that the nail can be inserted between the jaws (1) by contact of the end of the finger or toe with the shield (2). This also protects the finger or toe against engagement and injury with either the corner of the cutting edges (7) and (8).

Figure 5:
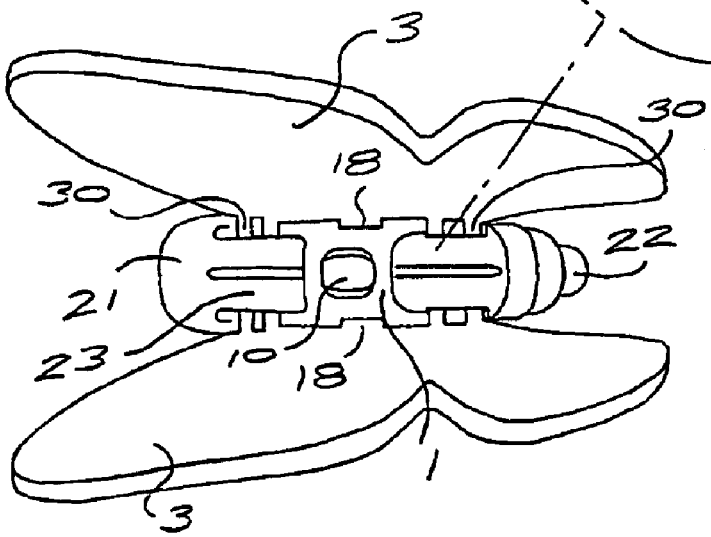
FIG. 5 shows a rear elevation of the clipper set.

Plugs (21, 22) are provided as an optional accessory and are generally conical in shape. The plugs (21,22) are moulded from a resiliently flexible plastics material and are integrally secured together by an elongate ribbed body (23) and a thin stem (24), as shown in the insert to FIG. 5. The body (23) extends from a side of each plug (21, 22) and is secured between the jaws(1) intermediate the bend (11) and the projections (30) on the manipulating levers (3). The stem (24) extends from the centre of each plug (21, 22) and between the projections (30) and the shield (2).The plugs (21,22) are thus biased by the body (23) and stem (24) into abutment against the sides of the shield (2) and the projections (30). Together with the shield (2) and jaws (1), the body (23) the plugs (21, 22) provide a containing space for matter entering between the cutting edges (7,8). In use, nail clippings are retained in the space and are collected for later disposal by pulling one of the plugs (21, 22) away from the shield (2) and allowing the clippings to fall out.

In this embodiment the plugs (21, 22) are made in the shape of a butterfly head (21) and body (22), to match the butterfly shape of the extensions.

Cutting is effected by pressing the manipulating levers (3) towards each other and thus dosing the cutting edges (7) and (8) against each other. During this movement the contacting surfaces between the strip (4) and the moulding slide over each other and the plastics material is preferably chosen to be one which provides inherent lubricating properties. The protrusions (18) serve to operate as cam surfaces acting on the depressions (19) in the jaws, to enhance the leverage and reduce the friction between jaws (1) and shield (2). The cams also direct the force onto the jaws (1) and centralise it, inhibiting any tendency of the blade to twist. The positioning of the cams can be varied in the length of the extensions to change the direction and magnitude of the leverage applied to the jaws (1).

The invention provides nail clippers which are safe, easy to use and which may be made aesthetically attractive. It will be appreciated, however, that many other embodiments of nail clippers exist which fall within the scope if the invention, particularly as regards the configuration thereof. For example, it is not necessary to mould the extensions integrally with the shield (2) or even each other. Instead, the shield (2) could form part of the jaw (1). Also, the manipulating levers (3) can have any suitable shape and need not be in the form of butterfly wings.

Figure 6:
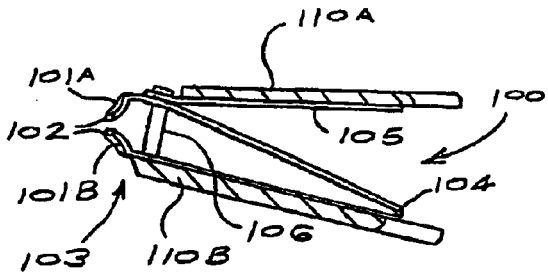
FIG. 6 shows a cross section through a further a clipper set.
Figure 4:
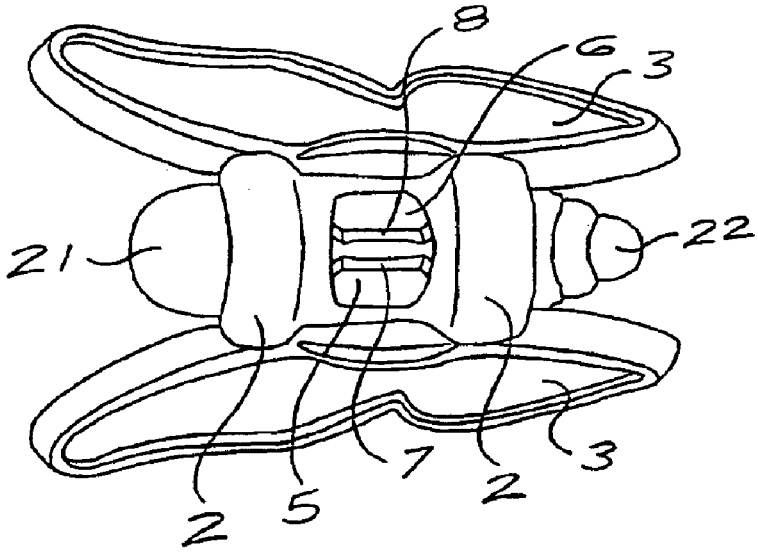
FIG. 4 shows a front elevation of the clipper set.
Figure 4:
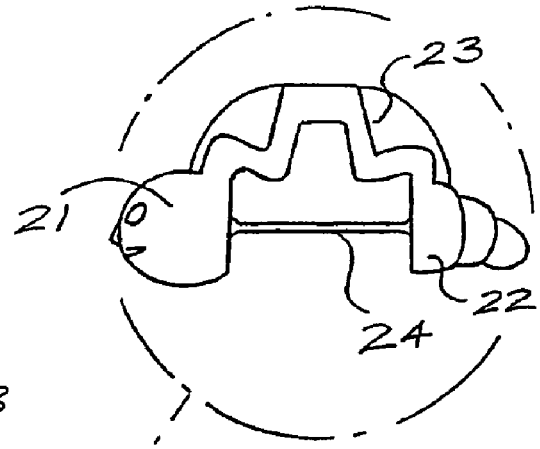

The invention also provides a pair of nail clippers which are made aesthetically appealing by the addition of moulded plastics finger grips on opposite sides of the jaws (1). As illustrated in FIG. 6 the nail clippers (100) can be of conventional construction having a pair of jaws (101*a*, 101*b*) shaped to form sharpened arcuate co-operating cutting edges (102) at one end (103) and connected together at the other end (104) with the length of the jaws bent to bias the jaws to an open position. An operating lever (105) is hinged to a pin (106) passing through the jaws (101*a*, 101*b*) adjacent the cutting edges (102) to provide means whereby the jaws (101*a*, 101*b*) can be moved together to provide a clipping action. According to the invention a finger grip (110*a*) is secured to the lever (105) and a further finger grip (110*b*) to the outer side of the jaw (101*b*). In this embodiment the finger grips (110*a*, 110*b*) are secured to the nail clipper (100) using an adhesive.

The finger grips (110*a*, 110*b*) are identical and similarly shaped to those described above to also provide the nail clippers (100) with the appearance of a butterfly.

By providing the nail clippers with an attractive appearance, such as a butterfly, they have been found to be appealing to children who, as a result, are less likely to struggle when having their nails clipped. It will be appreciated that the finger grips can be made to make the nail clippers resemble any suitable animate or inanimate object. The former includes animals, insects and plants while the latter includes vehicles. Thus, for example, the finger grips could be formed to look like the wings of a bird or bee, or to look like flower petals or leaves, or even to look like a motorcar or train. Preferably the object selected allows an identically shaped finger grip to be depicted.

While it is preferable that the finger grips are wider than the width of the jaws to enhance a user's purchase they may in fact be of similar width to that of the jaws.

What is claimed is:

1. Nail clippers comprising a pair of jaws that are shaped to provide oppositely disposed arcuate cutting edges and are joined together remote from the cutting edges, the jaws being biased to an open position and being movable against the bias to enable cutting of a nail locatable between the cutting edges, and, a shield extending around and projecting forwardly of corners of the cutting edges and extending rearwardly from the cutting edges to form manipulating levers for operating the jaws, wherein the shield and the manipulating levers are an integral moulding of resilient plastic material with the levers biased against movement towards each other.

2. Nail clippers according to claim 1, in which the manipulating levers carry protrusions in the form of cams shaped and positioned to direct force in use from the levers against the jaws.

3. Nail clippers according to claim 2, in which the cams are slidably engaged in depressions formed in the jaws.

4. Nail clippers according to claim 1, in which the shield and manipulating levers are securely retained on the jaws by barbed clips engaged on assembly of the jaws between the manipulating levers.

5. Nail clippers according to claim 4, in which the barbed clips extend from arcuate projections.

6. Nail clippers according to claim 5, in which the projections act as stops to limit the extent of movement between the jaws.

7. Nail clippers according to claim 1, in which the forward projection of the shield around the corners follows an arcuate shape.

8. Nail clippers according to claim 1 in which the manipulating levers provide wide finger grips.

9. Nail clippers according to claim 1, in which the manipulating levers are aesthetically designed.

10. Nail clippers according to claim 9, in which the manipulating levers take the form of butterfly wings.

11. Nail clippers according to claim 1, in which the jaws are integrally joined.

12. Nail clippers according to claim 1 in which a plug is movably secured at each side of the jaws adjacent the cutting edges to define together with at least one of the jaws and the shield a containing space for material cut by the cutting edges in use.

13. Nail clippers according to claim 12, in which the plugs are movable against a bias.

14. Nail clippers according to claim 12, in which the plugs are moulded integrally with a flexible body between the plugs.

15. Nail clippers according to claim 14, in which the body is secured between the jaws and spaced away from the cutting edges.

16. Nail clippers according to claim 15, in which each plug seats against the shield.

17. Nail clippers according to claim 12, in which the plugs are shaped to respectively resemble the head and body of a butterfly.

18. A kit comprising a pair of jaws and a shield, separately and apart from each other, and arrangeable to form a nail clipper in use, the pair of jaws shaped to provide oppositely disposed arcuate cutting edges and joined together remote from the cutting edges, the jaws being biased to an open position and being movable against the bias to enable cutting of a nail locatable between the cutting edges, and the shield extendible around and projectable forwardly of corners of the cutting edges and extending rearwardly to form manipulating levers for operating the jaws, wherein the shield and the manipulating levers are an integral moulding of resilient plastic material with the levers biased against movement towards each other.

19. The kit according to claim 18, in which the manipulating levers carry protrusions in the form of cams shaped and positioned to direct force in use from the levers against the jaws.

20. The kit according to claim 19, in which the cams are slidably engagable in depressions formed in the jaws.

21. The kit according to claim 18, in which the shield and manipulating levers are securely retainable on the jaws by barbed clips engaged on assembly of the jaws between the manipulating levers.

22. The kit according to claim 21, in which the barbed clips extend from arcuate projections.

23. The kit according to claim 22, in which the projections act as stops to limit the extent of movement between the jaws.

24. The kit according to claim 18, in which the forward projection of the shield around the corners follows an arcuate shape.

25. The kit according to claim 18 in which the manipulating levers provide wide finger grips.

26. The kit according to claim 18, in which the manipulating levers are aesthetically designed.

27. The kit according to claim 26, in which the manipulating levers take the form of butterfly wings.

28. The kit according to claim 18, in which the jaws are integrally joined.

29. The kit according to claim 18 in which a plug is movably secured at each side of the jaws adjacent the cutting edges to define together with at least one of the jaws and the shield a containing space for material cut by the cutting edges in use.

30. The kit according to claim 29, in which the plugs are movable against a bias.

31. The kit according to claim 29, in which the plugs are moulded integrally with a flexible body between the plugs.

32. The kit according to claim 31, in which the body is secured between the jaws and spaced away from the cutting edges.

33. The kit according to claim 32, in which each plug seats against the shield.

34. The kit according to claim 29, in which the plugs are shaped to respectively resemble the head and body of a butterfly.

* * * * *

UNITED STATES PATENT AND TRADEMARK OFFICE

CERTIFICATE OF CORRECTION

PATENT NO. : 7,024,774 B2
APPLICATION NO. : 10/469100
DATED : April 11, 2006
INVENTOR(S) : Michael P. Novellie et al.

It is certified that error appears in the above-identified patent and that said Letters Patent is hereby corrected as shown below:

On the Title Page:

At line Item (30), "0104742" should be -- 104742.2 --.

Signed and Sealed this

Twentieth Day of February, 2007

JON W. DUDAS
*Director of the United States Patent and Trademark Office*